US008080426B1

(12) United States Patent
Moore et al.

(10) Patent No.: US 8,080,426 B1
(45) Date of Patent: Dec. 20, 2011

(54) METHOD AND APPARATUS FOR CONTROLLING HYDROPROCESSING ON-LINE

(75) Inventors: Howard F. Moore, Ashland, KY (US); Sonia S. Bain, Huntington, WV (US); Maureen A. Chaffin, Huntington, WV (US)

(73) Assignee: Marathon Petroleum Company LP, Findlay, OH (US)

( * ) Notice: Subject to any disclaimer, the term of this patent is extended or adjusted under 35 U.S.C. 154(b) by 537 days.

(21) Appl. No.: 12/290,489

(22) Filed: Oct. 31, 2008

Related U.S. Application Data

(60) Provisional application No. 61/003,012, filed on Nov. 15, 2007.

(51) Int. Cl.
*C10G 17/00* (2006.01)

(52) U.S. Cl. ..... 436/120; 73/19.02; 73/23.35; 73/23.36; 73/23.37; 73/23.38; 208/178; 208/208 R

(58) Field of Classification Search ..... 73/19.02, 73/23.35–23.38; 208/208 R–250; 436/50, 436/55, 120
See application file for complete search history.

(56) References Cited

U.S. PATENT DOCUMENTS 5,246,868 A 9/1993 Busch
5,348,645 A * 9/1994 Maggard et al. ..... 208/209
5,472,875 A * 12/1995 Monticello ..... 435/282
5,510,265 A 4/1996 Monticello
5,744,702 A 4/1998 Roussis
5,837,130 A 11/1998 Crossland
5,919,354 A 7/1999 Bartek
6,063,265 A 5/2000 Chiyoda
6,130,095 A 10/2000 Shearer
6,140,647 A 10/2000 Welch
6,274,785 B1 * 8/2001 Gore ..... 585/833
6,312,586 B1 11/2001 Kalnes
6,368,495 B1 4/2002 Kocal
6,736,961 B2 5/2004 Plummer
7,074,321 B1 7/2006 Kalnes
7,087,153 B1 8/2006 Kalnes

OTHER PUBLICATIONS

Luyben, W.L. (1973). Process Modeling, Simulation, and Control for Chemical Engineers, McGraw-Hill, 558 pgs (Office action cites pp. 431-433).*

* cited by examiner

*Primary Examiner* — Robert J Hill, Jr.
*Assistant Examiner* — Brian McCaig
(74) *Attorney, Agent, or Firm* — Emch, Schaffer, Schaub & Porcello Co., L.P.A.

(57) ABSTRACT

This unique process is a feed forward control of hydroprocessing by on-line sulfur speciation. An on-line gas analyzer such as (GC) with a sulfur specific detector (AED) would be installed to analyze the feed to a hydrotreating unit. The analyzer would be calibrated to quantify the individual sulfur compounds or classes of sulfur compounds present in the feed. The output from the analyzer would be linked to the unit's distributed control system to automatically change temperatures and feed rates to change hydrotreating severity. This invention could bring economical benefits by increasing the life of the hydrotreating catalyst, reducing operating cost, and decreasing the potential amount of offspec product. In one embodiment, the hydrotreating is a hydrodesulphurization process.

22 Claims, 8 Drawing Sheets

| | |
|---|---|
| Past | 370 ppm LSD |
| | 3500 ppm HSD |
| Present | < 15 ppm on road |
| Present | < 500 ppm off road |
| Future | Zero sulfur |

Desulfurization kinetics are dictated by aromaticity and substituents in the 4 or 6 positions

METHOD AND APPARATUS FOR CONTROLLING HYDROPROCESSING ON-LINE

CROSS REFERENCE TO RELATED APPLICATIONS

This patent application claims the benefit of provisional patent application Ser. No. 61/003,012 filed Nov. 15, 2007.

TECHNICAL FIELD

This invention relates to controlling hydroprocessing on-line. More specifically, the present invention relates to feed forward control of a hydroprocessing (hydrodesulphurization) unit using an on-line gas analyzer in combination with a sulfur specific detector.

BACKGROUND OF THE INVENTION

Hydrodesulfurization (HDS) is a widely-used chemical process which uses catalysts to generate the reaction of hydrogen to remove sulfur and sulfur-contained components from petroleum during refining. The process addresses critical environmental and processing issues. First, the hydrodesulfurization process is required to prevent catalyst poisoning such as in reforming or in a car's catalytic converter. Second, sulfur reduction is necessary to meet environment specification in products such as gasoline or diesel.

New regulations went into effect in 2006 limiting the amount of total sulfur in diesel fuel to 15 ppm at the retail station. Refinery sulfur targets are currently 10 ppm or less to account for pick up of sulfur in the supply and distribution system. These lower sulfur specifications increase hydrotreating severity leading to decreased catalyst life and increased unit maintenance costs. Certain sulfur compounds or classes of compounds are more difficult to hydrotreat due to location of the sulfur on the molecule. The sulfur atom is sterically hindered in the molecule, and reaction with the hydrotreating catalyst may be significantly constrained. We have developed a unique way to quantify the amount and type of these compounds in the feed using a gas analyzer and a sulfur specific analyzer, and then use this data to optimize operation of the hydrotreating unit.

Other objects and advantages of the present invention will become apparent to those skilled in the art upon a review of the following detailed description of the preferred embodiments and the accompanying drawings.

SUMMARY OF THE INVENTION

We now have found an on-line use of a gas analyzerto quantify the quantity of specific sulfur compounds present in a hydroprocessing feed. Preferably the analyzer uses gas chromatography (GC). Several different type of detectors, including a sulfur chemiluminescence detector (SCD) or atomic emissions detector (AED), could be used to identify and quantify the sulfur compounds. The analyzer could be installed on-line or at-line for unit optimization. The outputs from the analyzer could be tied to a Distributed Control System (DCS) to feed forward control unit parameters such as reactor temperatures, feed rates, or feed component flows so the needed hydrotreating severity is achieved.

This unique operation is an on-line analytical method to quantify the individual sulfur compounds or classify sulfur groups in a hydroprocessing feed using a Gas Chromatograph/Atomic Emissions Detector (GC/AED) technique.

This data will be useful to hydroprocessing technologists and refinery unit engineers to understand those compounds that are difficult to hydrotreat due to steric hindrance of the sulfur molecule (e.g. 4,6-dimethyl dibenzothiophene). Unit hydrotreating severity has to be increased to remove the sulfur from these types of compounds, and production of ultra-low sulfur diesel (ULSD) has been found to be uniquely defined by the kinetics of those sterically hindered molecules rather than total sulfur content which has been classically used to calculate desulfurization kinetics. The use of a GC with a sulfur specific detector in an on-line application to feed forward control a hydroprocessing unit determines the sulfur components in real-time. The data is used to change unit temperatures or space velocities to optimize the process.

| | Pure Component Boiling Point, ° F. | Boiling Point Observed in Practice, ° F. |
|---|---|---|
| Benzothiophene | 430 | 400-420 |
| Dibenzothiophene | 630 | 570-590 |
| 4-methyl dibenzothiophene | 660* | 600-620 |
| 4,6-dimethyl dibenzothiophene | 690* | 630-650 |

*Estimated

Mayo, S. W., "The Perils and Pitfalls of Processing LCO," AKZO Nobel Catalysts

Figure 7:
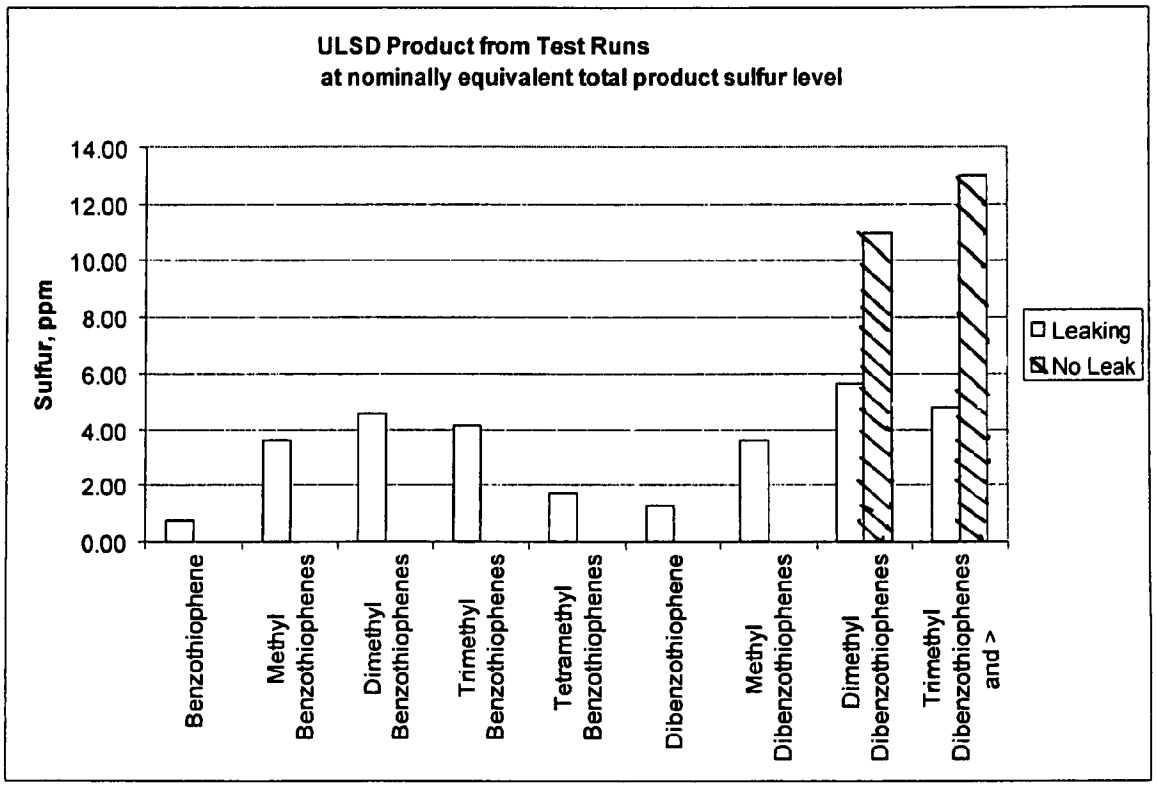

FIG. 7 is a graph showing product test runs for total product sulfur level. In particular, this graph demonstrates a technique for applying ULSD desulfurization kinetics to detecting leaks in a hydroprocessing unit.

Figure 8:
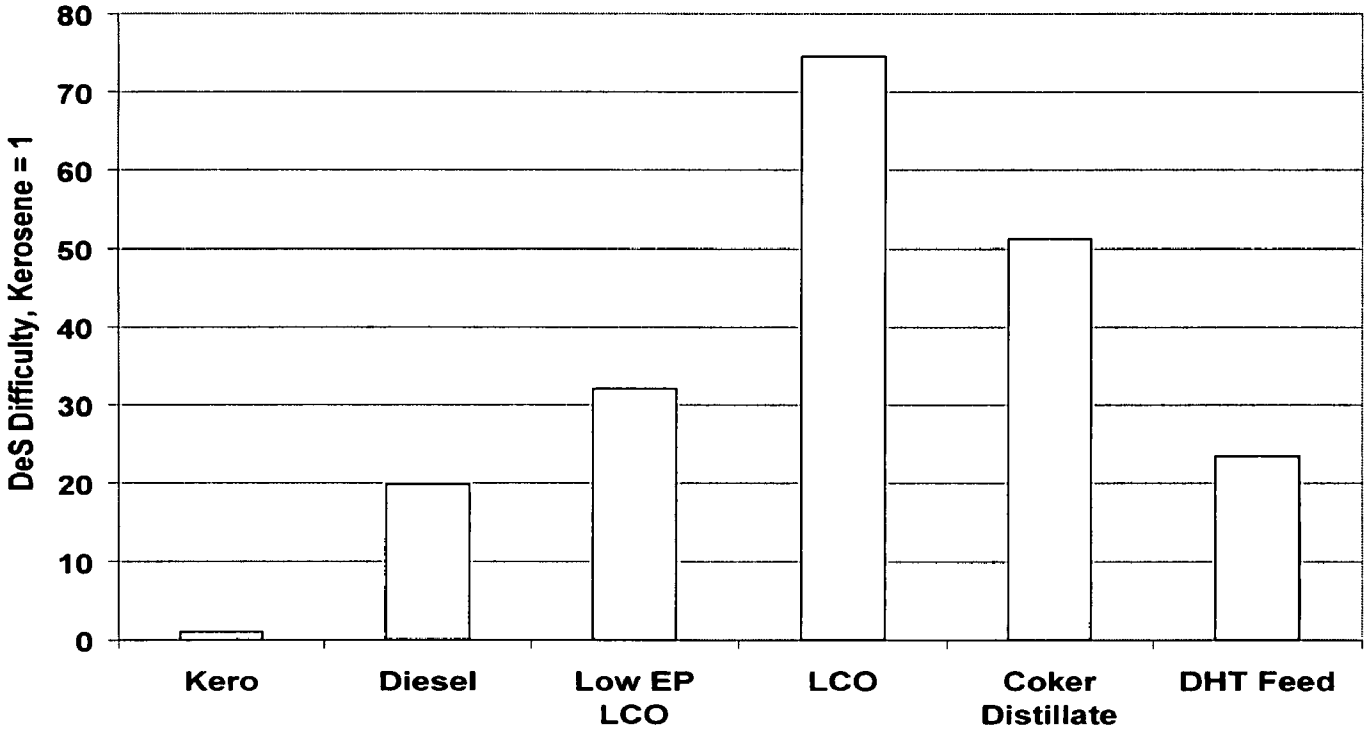

FIG. 8 is a chart showing the kinetic interpretation of a particular set of component distillate stream which has been calculated from sulfur speciation.

DETAILED DESCRIPTION OF THE INVENTION

An on-line gas analyzer with a sulfur specific detector would be installed to analyze the feed to a distillate hydrotreating unit operating with a desulfurization objective. The invention applies to distillate hydrotreaters, FCC feed hydrotreaters, gasoline hydrotreaters and other hydrotreaters. The analyzer would be calibrated to quantify the individual sulfur compounds or classes of sulfur compounds present in the feed. The output from the analyzer would be linked to the unit's distributed control system to automatically change unit temperatures and feed rates to change hydrotreating severity. This invention brings economical benefits by increasing the life of the hydrotreating catalyst, reduction of hydrogen consumption and overtreating, and reduces the amount of offspec product.

The gas analyzer may vary widely. Preferably, the gas analyzer uses gas chromatography (GC). Other examples include infrared gas analyzers, a non dispersive infrared (NDIR) gas analyzer, a Fourier transform infrared (FTIR) gas analyzer, and real time gas analyzers. Mass spectrometry such as residual gas analyzers (RGA) using open ion source (OIS) or closed ion source (CIS) sampling also may be used. Spectrometers such as near infrared (NIR) and mid infrared MIRI) spectrometers also are contemplated for use in this invention.

The instrumentation used in the feed forward control of a hydroprocessing unit using an on-line gas chromatograph with a sulfur specific detector may vary widely. For example, the system may control using a gas chromatograph coupled with mass spectrophotometric (GC/MS), nuclear magnetic resonance (GC/NMR), infrared spectrometric (GC/IR), X-ray fluorescence (GC/XRF) or atomic emission spectrometric (GC/AESI, flame spectrometry) detection systems.

Certain sulfur fragment ions can be used as quantitative indicators of their parent sulfur-containing species. These fragment ions and corresponding sulfur species or compounds are set forth in the following table.

| Fragment ion | Parent sulfur-containing species |
|---|---|
| $C_2H_5S^+$ | RSR/RSH |
| $H_2S_2^+$ | RSSR |
| $S_2^+$ | $S_{X1}$ RSSR |
| $CH_3S^+$ | RSR/RSH/RSSR |
| $CSH^+$ | RSR/RSH/RSSR, thiophenes |
| $SH^+$ | $H_2S_1$ RSR |

The invention applies to all hydrotreaters that are operated with desulfurization objectives. In particular the invention applies to those processes running to low product sulfur levels where a single molecule (or class of molecule) is kinetically controlling.

All desufurizers process a range of sulfur molecules, whether it be naphtha, kerosene, diesel, FCC feed or resid. Each of these molecules has its own unique kinetic requirements (e.g., temperature, pressure, catalyst volume) for sulfur removal. The difficulty of removal changes depending on feedstock, unit, and objective. Each hydrotreater is designed, philosophically, for a single key sulfur molecule. Recognizing that molecule, and measuring its input/output is the key to this invention. This is a unique concept leading to improved on-line control.

As an example, NHT units are designed for (philosophically) 99% removal of highly substituted thiophenes. These thiophenes are more refractory (require more severity, e.g. higher temperature, higher pressure, more catalyst) than simple thiophenes, mercaptans, and/or sulfides which are the other sulfur molecules in naphtha. So a feed forward speciation for NHT units would target highly substituted thiophenes and guard against benzothiophenes. If 99% removal of the highly substituted thiophenes is provided, the other (lighter) molecular species are 100% removed, so the key kinetics of interest are those of the substituted thiophenes.

For kerosene hydrotreaters, the molecule of interest is usually substituted benzothiophene (with a check to guard against dibenzothiophene). Unit design/parameters are based on substituted benzothiophene kinetics, and all of the lighter sulfur species are gone when most of the benzothiophenes are removed. So the analysis/control targets benzothiophenes, and there may be more than one key component so in this case the analyzer and control algorithm may track several compounds with similar kinetics.

In diesel hydrotreaters, to make ULSD more specifically, 4,6 dimethyl dibenzothiophene is the kinetically defining component, with a contribution from trimethyl or heavier dibenzothiophene with methyl or longer chain groups in the 4,6 positions.

Figure 1:
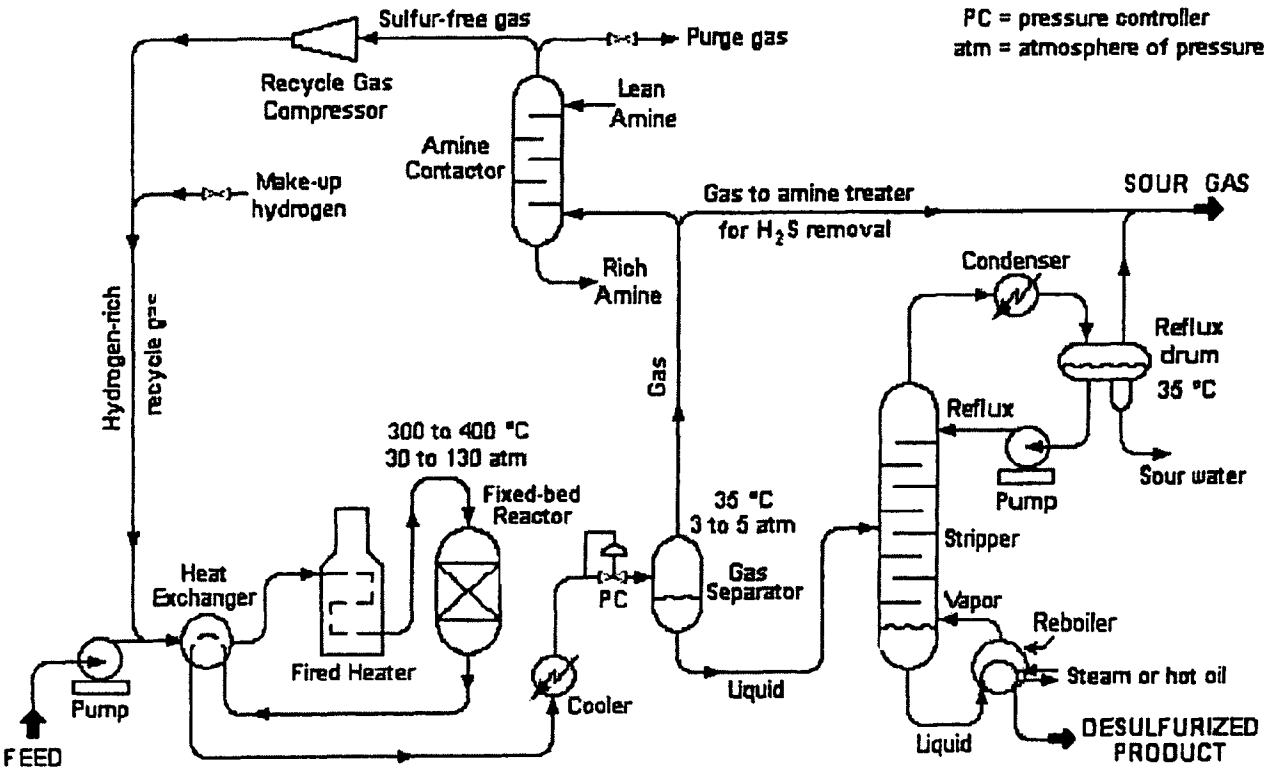
FIG. 1 is a flow diagram for a typical hydrodesulfurization process.
Figure 2:
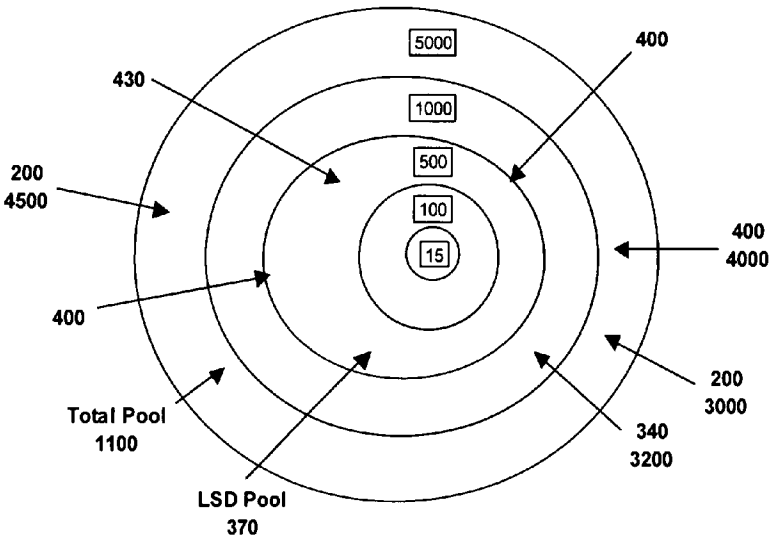
FIG. 2 is an area chart showing the diesel sulfur for past, present and future operations.
Figure 3:
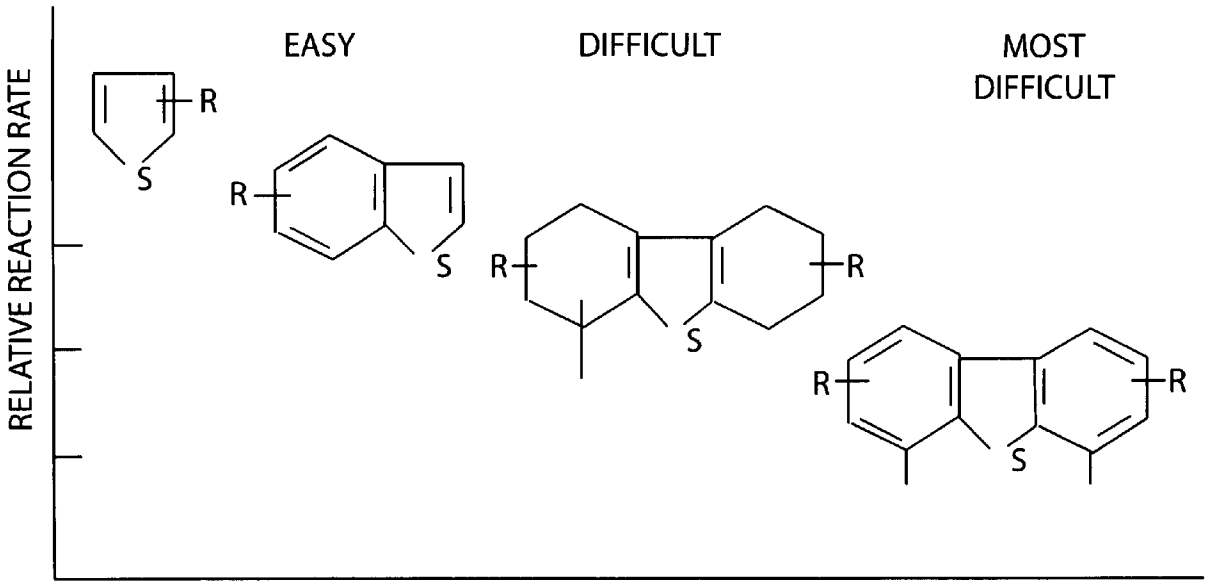
FIG. 3 is a chart showing desulfurization kinetics for substituents in the 4 or 6 positions.
Figure 4:
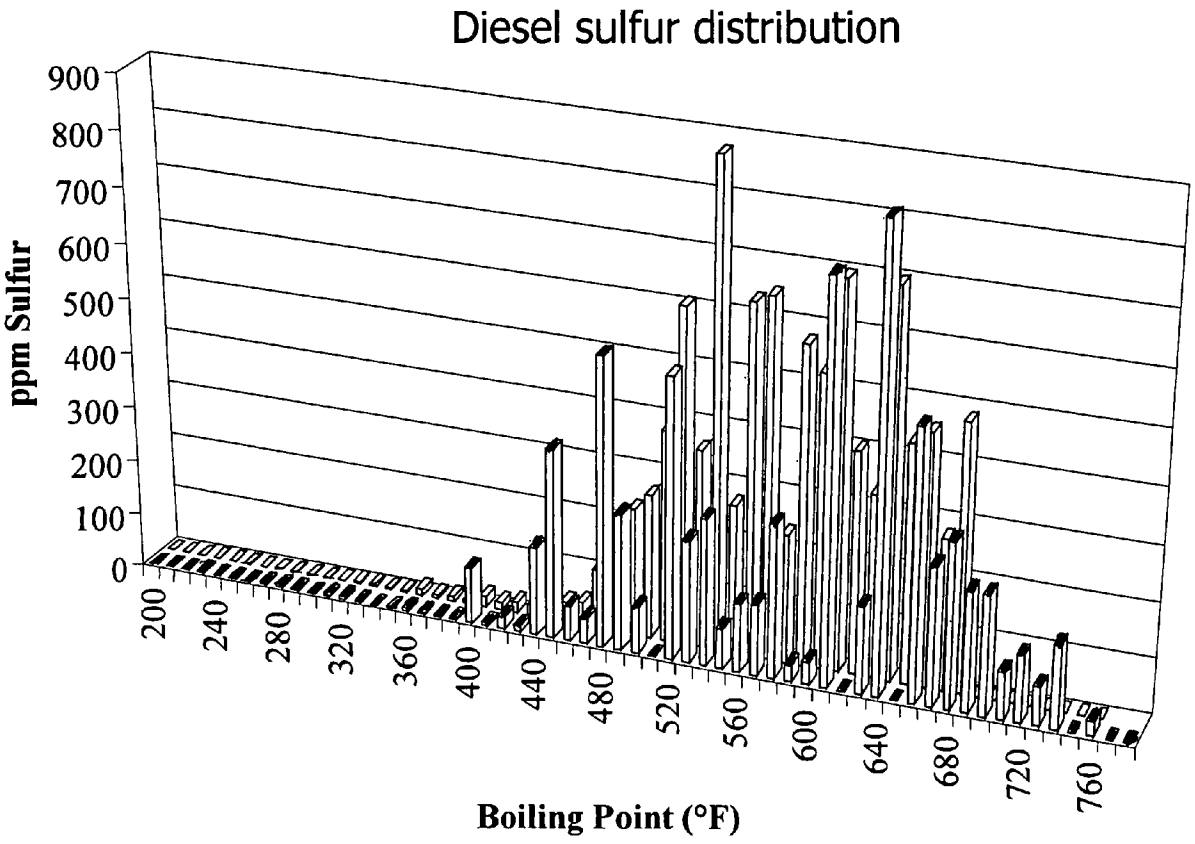
FIG. 4 is a graph showing diesel sulfur distribution before hydrotreating.
Figure 5:
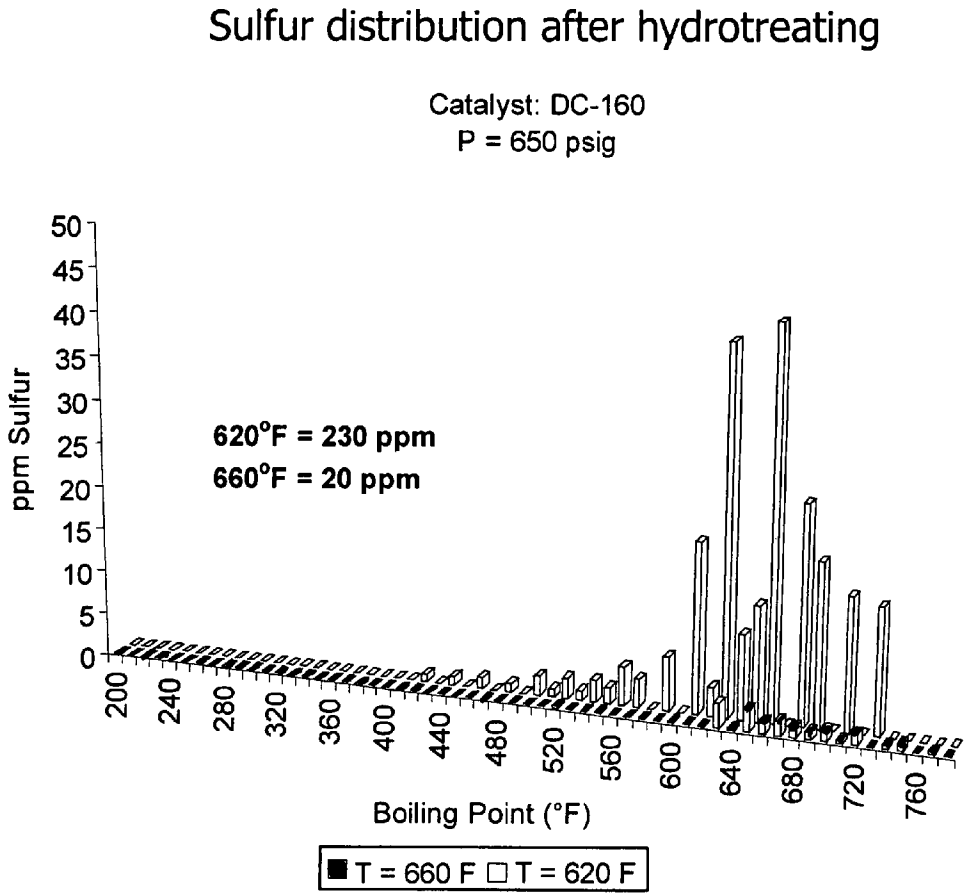
FIG. 5 is a graph showing sulfur distribution after hydrotreating at increasing severity.
Figure 6:
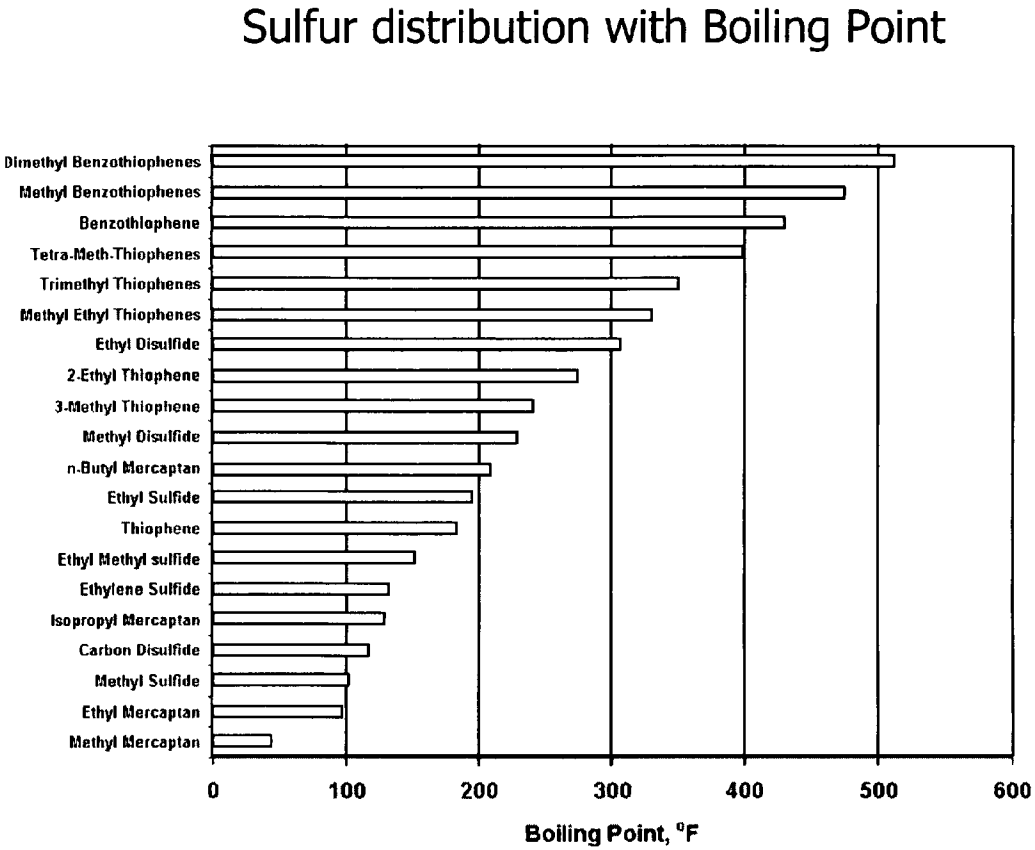
FIG. 6 is a graph showing sulfur distribution with boiling point for a range of sulfur molecules. The chart is for naphtha. The comparable distillate table is.

FIG. 6 demonstrates this very clearly. This chart is older data, vs. boiling point, but survival of 4,6 dimethyl (probably the lighter peak at about 630° F.) and trimethyl (probably the slightly higher boiling peak in the 640-650 range) is shown. If this data were at 10 ppm, only these two peaks would survive. All of the other minor peaks disappear. At 5 ppm, only the 4,6 peak survives. So if we know the amount of 4,6 dimethyldibenzothiphene coming in (or the CHANGE in amount coming in, which is good enough for control), we know how much to change severity. The TOTAL sulfur no longer dictates severity, which is a HUGE philosophical change from historical desulfurization operation and control. A further key concept in this invention is that, while we can usually identify the chemical species of interest, chemical identification is NOT REQUIRED—we just have to know which peak is the kinetically controlling molecule (i.e., the one that survives).

FIG. 7 shows an example in leak detection which is yet another advantage of this invention—by measuring feed and product specification on line, we know the kinetically controlling species at all times and can identify a leaking heat exchange as soon as it occurs, limited only by the level of detection of the instrument. Since the lighter species would not survive the hydrotreater, they must be coming from a feed leak. Once the leak is isolated, the product (purple bars) returned to the expected two peak distribution.

A very beneficial use of this invention is to control reactor severity when feed composition changes. Distillate products in refining are rarely single streams, and are blends of normally 2-10 or more intermediate streams. Each of these streams has their own unique sulfur composition and concentration of refractory sulfur species, and the relative flow of each will change with varying operations in the rest of the refinery.

FIG. 8 is a chart showing the kinetic interpretation of a particular set of component distillate stream which has been calculated from sulfur speciation.

In a real life situation, the rate of LCO could increase and diesel decrease; in this case they are very similar in total sulfur content, but the LCO has more refractory sulfur species and is at least 3 times more difficult to desulfurize. In the conventional feedback control case, we would not see any change in feed sulfur content and would not know a change had occurred until the hydroprocessing unit product sulfur began to increase in response to the more refractory feedstock, potentially resulting in offspec (high sulfur) product which must be slopped or reprocessed. Because of this danger, unit operators frequently run the unit very conservatively and overtreat to very low sulfur levels, increasing operating costs and reducing catalyst life. Feed forward control on the total feed sulfur would philosophically be an improvement, but because kinetics are dictated by the sulfur species, and not total sulfur, a feed forward control scheme based on total sulfur would not be successful in this case. However, if we could measure the refractory sulfur species in the feed, and tie that to a feed-forward controller, the operator would know (or the controls would automatically provide) to adjust the reactor temperature appropriately before offspec product was produced and without overtreating.

We are not limited to those sulfur peaks that we can identify (e.g., 4,6 dimethyldibenzothiophenes). All that's necessary is that we measure the peak(s) in the feed that correspond(s) to the peak(s) that survive in the product, so that we can quantify them.

Regarding on line leak detection, as soon as light sulfurs start showing up in the product analysis, we know we have a leak.

The key advantage to this invention are: 1. measuring feed and product sulfur distribution, online; 2. identifying the key kinetically limiting molecule(s)—may be more than one, but it'll be a limited number—in the product specification measured. It may be different for every feed blend or process (e.g. naphtha, kero, diesel, FCC feed, or different refineries that cut at different distillation points), but we an and will identify it from the online analysis when the product sulfur is on specification for that particular application. It may not be the sulfur compound that we expect it to be. For instance, a plant may cut their kerosene very heavy, and their key component might be 4,6 dimethyldibenzothiophene even though this compound is not normally in kerosene at all; 3. identifying that/those component(s) in the feed blend, and knowing when/how much they change; 4. using known or new kinetic equations, for instance for most this will be a simple first order reaction—but might be developed based on statistical or artificial intelligence methods—, to predict the severity changes required in the reactor before that feed blend hits the unit; and 5. making severity changes bse on the feed specification and equation, either manually or automatically, as that feed blend hits the unit so that product sulfur level does not change even though severity and feed composition is changing.

Hydrodesulfurization (HDS) is a wide-used chemical process which uses catalysts to generate the reaction of hydrogen to remove sulfur and sulfur-contained components from products and feedstock of refining. Most common sulfur-contain contaminates are sulfides, disulfides, thiols (mercaptans) and its various thiophene derivatives. Thiophene and its derivatives benzothiophene, dibenzothiophenes, are the most difficult to remove. With the assistance of HDS catalysts, it is possible to remove 99% or more of the sulfur compounds.

Reactions

1. Desired

RSSR'+H2-RH+R'H+H2S

RSH+H2RH+H2S

RSR'+2H2RH+R'H+H2S

Where R and R' are carbon groups

2. Undesired

RCH=R'CH+H2S mercaptans+H2

The reaction undergoes temperatures ranging from 200 to 400° C. and high pressures ranging from 10 to 130 atmospheres of absolute pressure (atm).

Description of the Catalysts

Many HDS catalysts are the combination of Cobalt and Molybdenum (CoMo) on alumina oxide (A1203) support. In some case the catalyst could be NiMo/A1203, trimetallic (NiCoMO/Al203), and in other embodiments could even be precious metal (Pt or Pd) or on a different substrate. This invention is applicable independent of, and applicable to, all hydroprocessing catalyst types.

Hydroprocessing Reactions

Heteroatom removal:

Desulfurization is the dominant reaction in refining applications

Denitrogenation is important in hydrocracker pretreating

Deoxygenation is not normally encountered, except synthetic (coal, shale) materials and with rerun streams (MTBE, EtOH)

Saturation:

Olefin saturation is performed for product stability and color

Aromatic saturation is important in solvents hydrogenation

Hydrocracking is an alternative for boiling range conversion

Relative Reaction Rates for NAPHTHAS:

| Compound Type | Relative Reaction Rate |
|---|---|
| Mercaptans | 120 |
| Sulfides | 60 |
| Thiopene | 3 |
| Benzothiophene | 1 |

Relative Reaction Rates for Distillates:

| Compound Class | Rate Constant | Comments |
|---|---|---|
| 1. Benzothiophenes | 0.25 | Easiest to remove |
| 2. Dibenzothiophenes | 0.06 | No substituents in 4 or 6 position |
| 3. Dibenzothiophenes | 0.02 | One 4 or 6 position alkyl group |
| 4. Dibenzothiophenes | 0.007 | Alkyl grups in both 4&6 positions |

Relative Reaction Rates for Distillate Components:

| Relative Reactivity of Diesel Feedstocks | |
|---|---|
| Feedstock | Relative Reactivity |
| Virgin Diesel | 100 |
| Full-range LCO | 40 |
| 30% Full-range LCO In virgin diesel | 80 |
| 630° F. EP LCO | 100 |

EXAMPLE I

The hydroprocessing stream was tested for gas oil cracking activity and selectivity using an ASTM Microactivity Test ("MAT") (ASTM procedure D-3907). The liquid product from each run was analyzed for sulfur using a gas chromatograph with an Atomic Emission Detector (GC-AED). Analysis of the liquid products with the GC-AED allows each of the sulfur species in the gasoline region to be quantified. For purposes of this example, the cut gasoline will be defined as $C_5$ to $C_{12}$ hydrocarbons that have a boiling point up to 430° F. The sulfur species included in the cut of gasoline range include thiophene, tetrahydrothiopene, $C_1$-C5 alkylated thiophenes and a variety of aliphatic sulfur species.

EXAMPLE II

An on-line Gas Chromatograph with a sulfur specific detector was installed to analyze the feed to a distillate hydrotreating unit. The analyzer was calibrated to quantify the individual sulfur compounds or classes of sulfur compounds present in the feed. The output from the analyzer would be linked to the unit's distributed control system to automatically change unit temperatures and feed rates to change hydrotreating severity.

The following details the use of an analytical GC method to quantify sulfur compounds present in a distillate hydroprocessing feed. A sulfur chemiluminescence detector (SCD) or atomic emissions detector (AED) were used to identify and quantify the sulfur compounds. The analyzer was installed on-line or at-line for unit optimization. The outputs from the analyzer was tiled to Distributed Control System (DCS) to feed forward control unit parameters such as reactor temperatures or feed rates so the needed hydrotreating severity is achieved.

A 5-point kinetics study on each reactor was performed at the following test conditions.

OPERATING CONDITIONS

| Material Balance ID | | A | B | C | D | E |
|---|---|---|---|---|---|---|
| H2 Gas Rate | scfb | 1400 | 1400 | 1400 | 1400 | 1400 |
| Pressure | psig | 758 | 758 | 758 | 758 | 758 |
| LHSV | $hr^{-1}$ | 0.65 | 0.70 | 0.70 | 0.70 | 0.99 |
| Pump Feed rate | kg/hr | 0.028 | 0.030 | 0.030 | 0.030 | 0.042 |
| Gas Rate | std ml/min | 135.1 | 145.5 | 145.5 | 145.5 | 205.7 |
| WABT | ° F. | 656 | 635 | 656 | 658 | 656 |
| Line Out Time | hr | 41 | 38 | 38 | 38 | 27 |

Line out time starts when desired conditions are reached.

Condition C is the reference condition. WABT determined from: $WABT=T_{in}+(2/3)\Delta T$—data was taken from PI (Process Book) using the inlet and outlet temperature of Reactor A and B. Pressure was determined from the inlet Reactor pressure or high pressure separator pressure inlet reactor pressure is 865 psi and separator pressure is 740 psi also have to take in consideration the hydrogen purity: recycle purity=87.6% make-up purity=91.9%.

| | recycle (psi) | make-up (psi) |
|---|---|---|
| Reactor | 758 | 795 |
| Separator | 648 | 680 |

The range in space velocity is based on a common±20% difference from past studies. The range in WABT is based on a common 10-15° difference from past studies.

MODIFICATIONS

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A process for feed forward and feedback control of hydroprocessing comprising the steps of:

using an on-line gas analyzer in combination with a sulfur specific detector to analyze for specific sulfur components;

determining sulfur components in hydrocarbon feeds, intermediate products or final products in real time;

generating data from the step of determining the sulfur components in real time;

controlling on-line in response to the generated data, at least one parameter of the hydroprocessing; and using the analysis for on-line leak detection.

2. The process of claim 1 wherein the analysis is used to change the parameter of feed rate, reactor temperature, feed preheat, feed pressure, or feed composition.

3. The process of claim 1 wherein the analysis is used to change the parameter of hydroprocessing temperature or space velocities.

4. The process of claim 1 wherein the controlling increases or decreases hydrotreating severity to remove sulfur.

5. The process of claim 1 further comprising the steps of using the analysis to quantify the quantity of the specific sulfur components.

6. The process of claim 1 further comprising the step of using the analysis to control feed component flows to achieve needed hydrotreating severity.

7. The process of claim 1 wherein the gas analyzer is a gas chromatograph analyzer.

8. The process of claim 7 wherein the gas chromatograph is coupled with mass spectrophotometric (GC/MS), nuclear magnetic resonance (GC/NMR), infrared spectrometric (GC/IR), X-ray fluorescence (GC/XRF) or atomic emission spectrometric GC/AES, or flame spectrometry detection systems.

9. The process of claim 1 wherein the sulfur specific detector is an atomic emissions detector.

10. The process of claim 1 wherein the step of on-line leak detection is initiated as soon as light sulfurs show up in the analysis.

11. The process of claim 1 wherein the on-line analysis measures feed and product sulfur distribution.

12. The process of claim 1 wherein the online analysis identifies at least one key kinetically limiting molecule.

13. The process of claim 1 further comprising the step of measuring sulfur peaks in the feed that correspond to sulfur peaks that survive in the product.

14. The process of claim 1 wherein the sulfur components are sulfur species of: $C_2H_5S^+$, $H_2S_2$, $S_2^+$, $CH_3S^+$, $CSH^+$, $SH^+$.

15. The process of claim 1 where the hydrocarbon feed is a petroleum fraction selected from the group consisting of naphtha, gasoline, diesel fuel, jet fuel, kerosene, vacuum gas oil, and mixtures thereof.

16. The process of claim 1 where the sulfur component is selected from the group consisting of thiophene, benzothiophene, dibenzothiophene, alkylated dibenzothiophenes, and mixtures thereof.

17. The process of claim 1 further comprising the subsequent step of separating the sulfur component from the hydrocarbon feed.

18. The process of claim 1 further comprising the subsequent step of linking the data from the on-line detector to a distributed control system to automatically change hydroprocessing parameters.

19. The process of claim 1 wherein the hydroprocessing is a hydrodesulphurization process.

20. The process of claim 1 comprising the subsequent step of configuring the on-line detector to analyze for a single sulfur species.

21. The process of claim 1 comprising the subsequent step of configuring the on-line detector to processes running to low product sulfur levels where a single sulfur species is kinetically controlling.

22. The process of claim 1 further comprising the step of producing ultra-low sulfur diesel.

* * * * *